United States Patent [19]

Bancel et al.

[11] 4,226,298

[45] Oct. 7, 1980

[54] EXHAUST DEVICE FOR INTERNAL COMBUSTION ENGINES

[75] Inventors: Guy H. Bancel, 83, rue Petit, 75019 Paris, France; Francois N. E. Varigas, Paris, France

[73] Assignee: Guy Henri Bancel, Paris, France

[21] Appl. No.: 58,378

[22] Filed: Jul. 17, 1979

Related U.S. Application Data

[63] Continuation of Ser. No. 736,937, Oct. 29, 1976, abandoned.

[51] Int. Cl.[3] ..... F01N 1/16

[52] U.S. Cl. ..... 181/226; 181/241; 181/247; 181/252; 181/264; 181/277; 60/314

[58] Field of Search ..... 181/211, 212, 215, 216, 181/217, 219, 227, 226, 241, 277, 224, 264, 282, 247, 252, 256; 60/314, 324, 342

[56] References Cited

U.S. PATENT DOCUMENTS

| | | | |
|---|---|---|---|
| 2,671,523 | 5/1954 | Walker | 181/264 |
| 2,865,169 | 12/1958 | Hausmann | 181/215 |
| 3,263,772 | 8/1966 | Irwin et al. | 181/227 |
| 3,726,092 | 4/1973 | Raczuk | 60/314 |
| 3,786,791 | 1/1974 | Richardson | 60/314 |
| 3,884,323 | 5/1975 | Kunz, Jr. | 181/247 |

*Primary Examiner*—L. T. Hix
*Assistant Examiner*—Benjamin R. Fuller
*Attorney, Agent, or Firm*—Haseltine, Lake & Waters

[57] ABSTRACT

An exhaust device is provided comprising a first diverging portion extending into a cylindrical envelope into which is axially displaceably mounted a streamlined conically shaped member adapted to be moved in relationship to the engine rating.

6 Claims, 3 Drawing Figures

A
10
11
12
13
14
15
16
17
18
19
20
21
22
23
f
M

EXHAUST DEVICE FOR INTERNAL COMBUSTION ENGINES

This is a continuation of application Ser. No. 736,937, filed Oct. 29, 1976, now abandoned.

FIELD OF THE INVENTION

This invention relates to an exhaust device for internal combustion engines.

BACKGROUND

It has already been suggested to improve the performance of certain internal combustion engines, to shape their exhaust pipe with a diverging section then a converging section as seen in the direction of the gas flow, such a device being sometimes referred to as an "extractor". However, because such devices are only fully operational in a small operating range of the engine, i.e. in a small range of rotational speeds, they do not enable to satisfy the imposed requirements of noise level limitations for the exhaust of the engine which is equipped with them.

However, there exists, in other respects, a large number of silencer devices for internal combustion engines of the type comprising deflectors or absorbing materials, such silencers introduce by their construction perturbations in the flow of exhaust gases, which generally results in a reduction in performance of the engines with which they are associated.

SUMMARY OF THE INVENTION

It is an object of this invention to provide an exhaust device for internal combustion engines which eliminats the disadvantages of the above mentioned means and which, in particular, leads to an improvement in the performance of the engine which is equipped with them, at least as significant as that obtained by means of devices of the "extractor" type, without presenting the disadvantages inherent to these devices.

It is also another object of this invention to provide such a device, which, contrarily to known devices of the "extractor" type, are operational in a very wide operating range of the engine which is equipped with it.

According to this invention, an exhaust device for internal combustion engines comprising a pipe which in the direction of flow of the exhaust gases, comprises first a portion with a transverse cross-section increasing progressively, then a portion with a transverse cross-section progressively decreasing is characterized in that the portion with progressively decreasing cross-section comprises an external substantially cylindrical envelope into which is mounted a streamlined member having substantially the same axis as that of the envelope and which defines with said external envelope an assembly in which the exhaust gases flow without perturbation in a manner similar to the exhaust flow of gases in an extractor.

In a preferred embodiment, the streamlined member is shaped with a conical or ogival surface.

According to another feature of this invention, the streamlined member is movably mounted into the external envelope along the axis thereof and in a preferred embodiment, such movement is controlled in relation to the engine rating.

BRIEF DESCRIPTION OF THE DRAWING

The invention will be better understood from the following description given as an example and with reference to the accompanying drawing, wherein.

DETAILED DESCRIPTION

Figures 1, 2, 3:
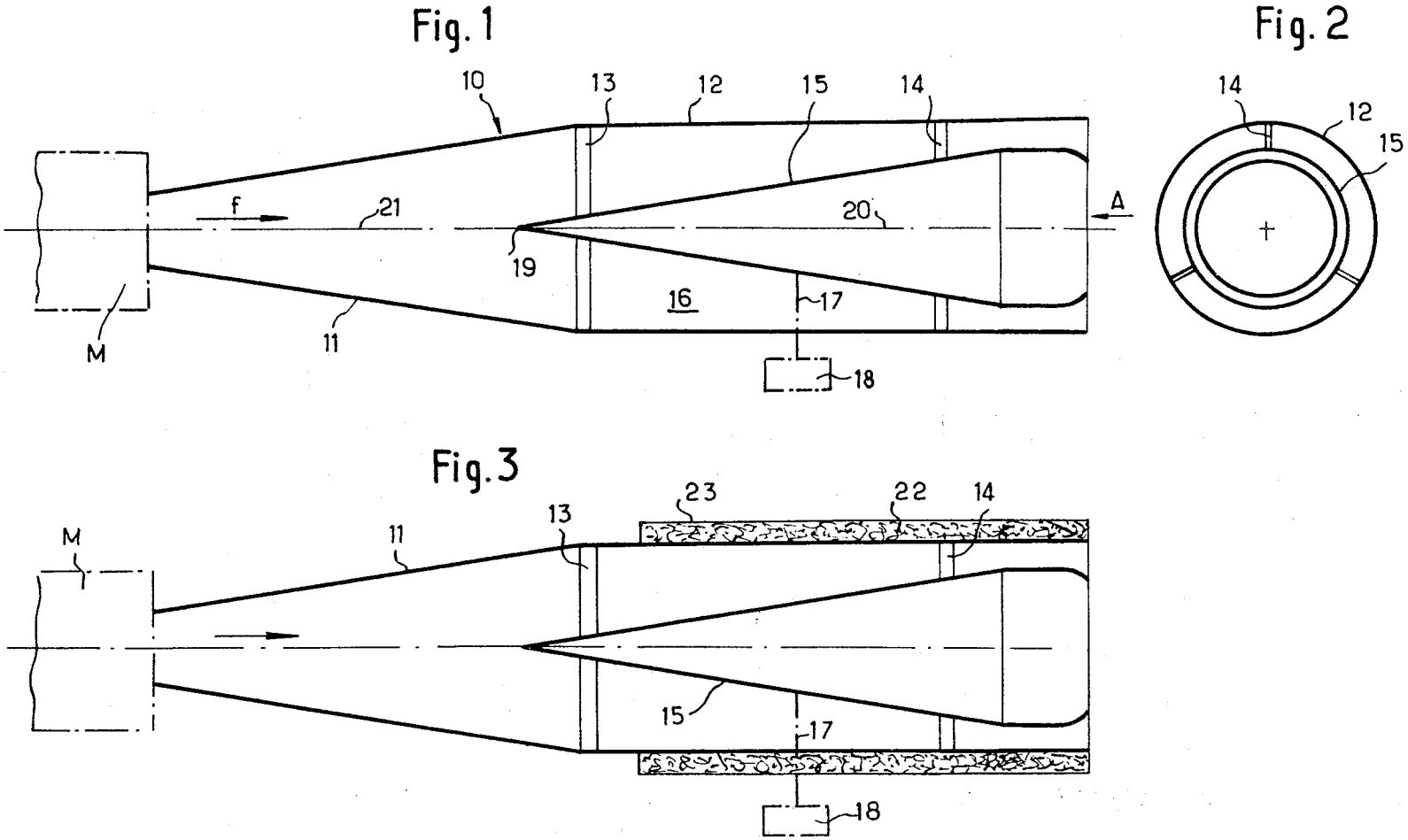
FIG. 1 is a diagrammatical longitudinal sectional view of a device according to this invention.
FIG. 2 is an end view of the device as seen in the direction in arrow A of FIG. 1.
FIG. 3 is a view similar to that of FIG. 1, but for an alternative embodiment.

FIGS. 1 and 2 shows an exhaust device 10 for an internal combustion engine which according to this invention, comprises a diverging section 11 connected to an engine M, which extends, in the direction of flow of the exhaust gases shown by arrow f, into an external envelope 12. Into the latter, preferably of cylindrical shape, is mounted by means of supports 13 and 14, a streamlined member 15 which defines in conjunction with the envelope 12 an annular space 16 with progressively decreasing cross-section in the direction of flow of the exhaust gases.

In one embodiment, the streamlined member 15 is shaped with an ogival or conical surface with a vertex 19 and its axis 20 is preferably coaxial with the axis 21 of the envelope 12.

The streamlined member 15 is preferably movably mounted inside envelope 12, the direction of movement being that of arrow f and the direction opposite thereto. This movement is carried out by means, not shown, adapted to be controlled in relationship with the rating of the engine through a connection 17 from a member 18, which can for example, be the throttle lever of a motorcycle engine or the accelerator pedal of a car engine, when the engine is that of a motor vehicle.

The operation of the device according to this invention is similar to that of a device of the "extractor" type in respect to the flow of the exhaust gases. In the device of the invention, however, the vertex 19 of the streamlined member 15 acts upon the sound wave system to cause a vibration node to appear at said vertex with, therefore, a decrease in noise relative to that generated by a conventional exhaust.

Complementarily, the longitudinally displaceable mounting of the streamlined member 15 and the control of the movement subject to the rating of the engine, through connection 17 enables an automatic adjustment of the flow characteristics of the exhaust gases in relation to the rotational speed of the engine, the efficiency of which is thus improved continuously.

In the alternative embodiment, FIG. 3, on the totality or on part of the length of the envelope 12, which is provided with openings, a sleeve member 22 is disposed in an acoustically isolating material, such as fiberglass, rock wool or the like enclosed in an external tubing 23.

In such a device, the operation of which is similar to that of the embodiment described hereabove, the absorption of the high frequency sounds by the sleeve 22 contributes to the achievement of a particularly satisfactory sound level.

What is claimed:

1. An exhaust device for an internal combustion engine with an external envelope comprising in the direction of flow of the exhaust gases, a first section defined by a progressively increasing cross-section, a cylindrical section following said first section the diameter of which is equal to the greater diameter of said first section, and said cylindrical section being further defined with its interior provided with a streamlined member with an ogival or conical surface which is substantially coaxial with said cylindrical section and the vertex of which is upstream, exhaust gases flowing without any perturbation of the fluid stream inside said first section and, after, through a progressively decreasing cross-section, between the streamlined member and the cylindrical section of the envelope.

2. A device according to claim 1, wherein said streamlined member is movably mounted inside the external envelope, and means for moving said streamlined member in accordance with the rotational rating of the engine.

3. A device according to claim 1 wherein said external envelope is perforated said device further comprising a sleeve of acoustically insulating material surrounding said envelope.

4. A device according to claim 2, adapted to be used in a motor vehicle comprising an accelerator pedal, wherein said means for controlling the movement of the streamlined member in accordance with engine speed includes said accelerator pedal.

5. A device according to claim 2 adapted to be used in a motor cycle comprising a throttle lever, wherein said means for controlling the movement of the streamlined member in accordance with engine speed includes said throttle lever.

6. A device according to claim 1, wherein said streamlined member is so mounted that its vertex acts upon the sound wave of exhaust gases to produce a vibration node at said vertex.

* * * * *